US011401941B2

(12) United States Patent
Saito et al.

(10) Patent No.: US 11,401,941 B2
(45) Date of Patent: Aug. 2, 2022

(54) AIR BLOWER

(71) Applicant: NIDEC COPAL ELECTRONICS CORPORATION, Tokyo (JP)

(72) Inventors: Yusuke Saito, Sano (JP); Masatoshi Obayashi, Sano (JP); Kyosuke Saso, Sano (JP); Tadashi Okabe, Sano (JP); Toshiya Uchida, Sano (JP)

(73) Assignee: NIDEC COPAL ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 17/171,229

(22) Filed: Feb. 9, 2021

(65) Prior Publication Data

US 2021/0164486 A1 Jun. 3, 2021

Related U.S. Application Data

(63) Continuation of application No. PCT/JP2019/027211, filed on Jul. 9, 2019.

(30) Foreign Application Priority Data

Aug. 24, 2018 (JP) ..... JP2018-157348

(51) Int. Cl.
*F04D 29/26* (2006.01)
*F04D 19/00* (2006.01)
*F04D 29/32* (2006.01)

(52) U.S. Cl.
CPC ..... *F04D 29/263* (2013.01); *F04D 19/002* (2013.01); *F04D 29/325* (2013.01)

(58) Field of Classification Search
CPC .... F04D 29/263; F04D 19/002; F04D 29/325; F04D 29/329
See application file for complete search history.

(56) References Cited

U.S. PATENT DOCUMENTS 6,979,177 B2 * 12/2005 Lin ..... F04D 25/0613 310/156.26
8,690,547 B2 * 4/2014 Nagamatsu ..... F04D 25/0613 417/354

(Continued)

FOREIGN PATENT DOCUMENTS

CN 201241860 5/2009
CN 201241862 5/2009

(Continued)

OTHER PUBLICATIONS

International Search Report for International Application PCT/JP2019/027211, dated Sep. 17, 2019.

(Continued)

*Primary Examiner* — Sabbir Hasan
(74) *Attorney, Agent, or Firm* — Burris Law, PLLC

(57) ABSTRACT

An air blower capable of preventing a deformation of the vane wheel is provided. A cylindrical holder is provided on rotatable shaft. A vane wheel is provided on the outer circumference of the holder. The holder includes a top section including a plurality of first openings at one end thereof in the axial direction, and includes a flange including a plurality of second openings at the other end thereof, and the vane wheel includes first protrusions to be inserted into the first openings of the holder and fixed to the top section by deformed sections protruding from the first openings, and second protrusions to be inserted into the second openings of the holder and fixed to flange by deformed sections protruding from the second openings.

6 Claims, 8 Drawing Sheets

(56) References Cited

U.S. PATENT DOCUMENTS

| | | | | |
|---|---|---|---|---|
| 9,568,008 | B2 * | 2/2017 | Huang | F04D 25/0613 |
| 2008/0219845 | A1 | 9/2008 | Chen et al. | |
| 2013/0052019 | A1 * | 2/2013 | Ions | F04D 29/083 416/174 |
| 2013/0323040 | A1 | 12/2013 | Fujita | |
| 2014/0191603 | A1 | 7/2014 | Lim | |
| 2015/0377238 | A1 | 12/2015 | Fujimoto et al. | |

FOREIGN PATENT DOCUMENTS

| | | |
|---|---|---|
| CN | 106762826 | 5/2017 |
| JP | S47026306 | 11/1972 |
| JP | 3277641 | 4/2002 |
| JP | 2013226035 | 10/2013 |
| JP | 2013245658 | 12/2013 |
| JP | 2016011627 | 1/2016 |
| TW | 200720553 | 6/2007 |
| TW | 200837283 | 9/2008 |

OTHER PUBLICATIONS

Office Action issued in corresponding CN Application 201980054820.X, dated Mar. 8, 2022, and an English translation thereof.

* cited by examiner

AIR BLOWER

CROSS-REFERENCE TO RELATED APPLICATIONS

This application is a Continuation Application of PCT Application No. PCT/JP2019/027211, filed Jul. 9, 2019 and based upon and claiming the benefit of priority from prior Japanese Patent Application No. 2018-157348, filed Aug. 24, 2018, the entire contents of all of which are incorporated herein by reference.

FIELD

The present invention relates to an air blower such as a fan motor, blower, and the like.

BACKGROUND

For preventing breakage of the vane wheel, a centrifugal compressor provided with a concavely formed outer circumference on the rotational shaft, and further provided with a convexly formed inner circumference to be fitted onto the concavely formed circumference in the vane wheel is developed (see, for example, JP S47-26306 U).

A sirocco fan motor having a configuration contrived in such a manner that an ultrasonically welded rib of the vane wheel comes into tight contact with the inner part of the through hole of the rotor frame when the vane wheel is ultrasonically welded to the rotor frame by providing the through hole of the rotor frame with a chamfered part or counterbored part in order to prevent a backlash between the rotor frame and vane wheel is developed (see, for example, JP 3277641 B).

SUMMARY

In general, a rotor of a fan or blower serving as an air blower has a metallic holder being provided on a shaft rotatable relatively to the stator, and a vane wheel made of a resin and called an impeller is fixed to the holder by insert molding or by using an adhesive. Further, a high degree of accuracy in the balance of the rotor is required of the fan or blower and, in order to achieve a high degree of accuracy in the balance, balancing weight for balance adjustment is added to, for example, the vane wheel.

When the rotor having such a configuration is rotated at a high rotational speed or is driven in a high-temperature environment, the vane wheel made of a resin is deformed due to a difference between the holder and vane wheel in strength or linear expansion coefficient. When the vane wheel is deformed, there is a problem that the balance of the rotor is lost, and due to an increase in the load applied to the bearing, vibration or sound is caused or the life of the bearing or life of the product itself is shortened.

Embodiments described herein aim to provide an air blower capable of preventing a deformation of the vane wheel from occurring.

According to one embodiment, an air blower comprising: a rotatable shaft; a cylindrical holder provided on the shaft; and a vane wheel provided on the outer circumference of the holder, wherein the holder includes a top section including a plurality of first openings at one end thereof in the axial direction, and includes a flange including a plurality of second openings at the other end thereof, and the vane wheel includes first protrusions to be inserted into the first openings of the holder and fixed to the top section by deformed sections of the first protrusions outwardly protruding from the first openings, and second protrusions to be inserted into the second openings of the holder and fixed to flange by deformed sections of the second protrusions outwardly protruding from the second openings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Figure 1:
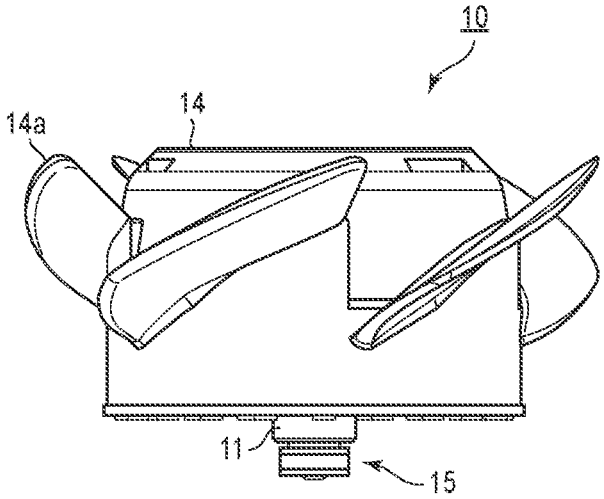
FIG. 1 is a side view showing a rotor taken out of an air blower according to a first embodiment.

Hereinafter, embodiments will be described with reference to the accompanying drawings. In the drawings, the same elements are denoted by the same reference numerals.

Figure 2:
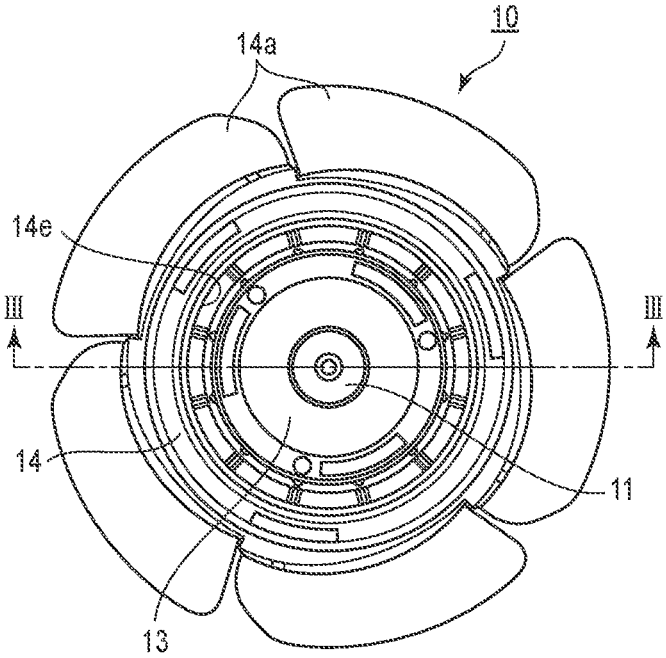
FIG. 2 is a top view of FIG. 1.
Figure 3:
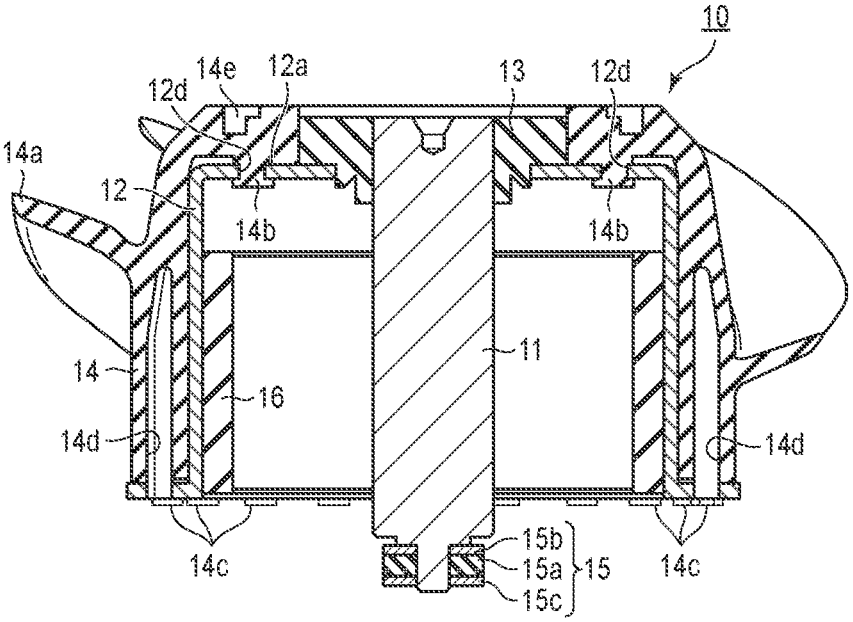
FIG. 3 is a cross-sectional view along line III-III of FIG. 2.

FIG. 1 to FIG. 3 are views showing a first embodiment, and show a rotor 10 to be applied to, for example, a fan motor serving as an air blower.

As shown in FIG. 3, the rotor 10 is provided with, for example, a shaft 11, holder 12, fixing member 13, vane wheel 14, magnetic bearing 15, and permanent magnet 16.

The shaft 11 has, for example, a columnar shape, the fixing member 13 is fixed to one end of the shaft 11, and the other end thereof is provided with a permanent magnet 15*a*, yoke 15*b*, and yoke 15*c* each constituting part of the magnetic bearing 15. The permanent magnet 15*a*, yoke 15*b*, and yoke 15*c* each have a ring-like shape, and yoke 15*b* and yoke 15*c* are respectively provided on the magnetic poles of the permanent magnet 15*a*.

Around the shaft 11, aero-dynamic pressure is produced by the rotation of the shaft 11 in a state where the shaft 11 is inserted into a sleeve serving as a bearing member to be described later. For this reason, in the circumferential surface of the shaft 11, a plurality of V-shaped grooves (not shown) which are so-called herringbone grooves are provided.

Although in the fan motor according to the first embodiment, for example, an aero-dynamic pressure bearing is used, other types of bearings can also be applied.

The holder 12 is made of, for example, a metal, is fixed to the fixing member 13, and is made rotatable together with the shaft 11. If the holder 12 can directly be joined to the shaft 11, the fixing member 13 can be omitted.

Figure 4:
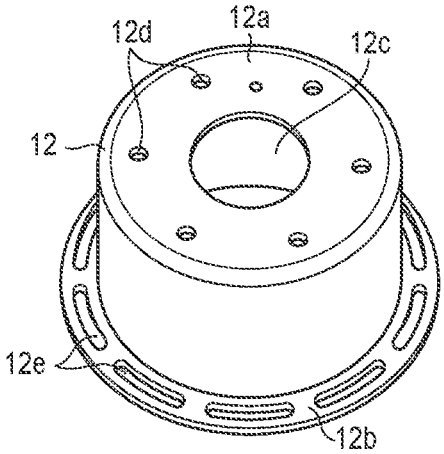
FIG. 4 is a perspective view showing a part of the rotor taken out of the rotor.

As shown in FIG. 4, the holder 12 has a cylindrical shape, includes a top section 12*a* at one end thereof in the axial direction, and includes a flange 12*b* at the other end thereof. At a central part of the top section 12*a*, a circular opening section 12*c* is provided, and the fixing member 13 is fitted into the opening section 12*c*. Furthermore, the top section 12*a* includes a plurality of first openings 12*d* along the inner circumference of the opening section 12*c*.

The flange 12*b* is provided in such a manner as to protrude from the outer circumference of the holder 12, and includes a plurality of second openings 12*e*. Although each of the second openings 12*e* is, for example, a long hole, the opening is not limited to the long hole, and may also be a circular hole.

As shown in FIG. 3, the permanent magnet 16 constitutes, for example, part of the motor. The permanent magnet 16 has a cylindrical shape, and is fixed to the inner surface of the holder 12.

The vane wheel 14 is made of, for example, a resin, and is provided with a plurality of fins 14*a* as shown in FIG. 1 and FIG. 2. Although the vane wheel 14 is shown as a case where the vane wheel 14 is, for example, an axial fan, the vane wheel 14 is not limited to the axial flow fan, and may also be a centrifugal fan.

As shown in FIG. 3, the vane wheel 14 is fixed to the outer side of the holder 12. At one end section of the vane wheel 14 in the axial direction thereof and corresponding to the top section 12*a* of the holder 12, a plurality of first protrusions 14*b* to be inserted into the plurality of first openings 12*d* of the holder 12 are provided. In a state where the plurality of first protrusions 14*b* are inserted into the plurality of first openings 12*d*, part of each of the first protrusions 14*b* outwardly protruding from each of the first openings 12*d* is deformed by thermal caulking utilizing, for example, ultrasonic waves, whereby the deformed sections (caulked sections) are formed. The vane wheel 14 is fixed to the top section 12*a* of the holder 12 by means of the deformed sections.

Further, at the other end section of the vane wheel 14 in the axial direction and corresponding to the flange 12*b* of the holder 12, a plurality of second protrusions 14*c* are provided. At the other end section of the vane wheel 14 and along the circumference thereof, a first groove 14*d* into which a weight (not shown) for adjusting the balance of the rotor 10 is to be inserted is provided and, inside the first groove 14*d*, a plurality of second protrusions 14*c* are provided. In the state where the tips of the plurality of second protrusions 14*c* are inserted into the plurality of second openings 12*e*, part of each of the second protrusions 14*c* outwardly protruding from each of the second openings 12*e* is deformed by thermal caulking utilizing, for example, ultrasonic waves, whereby the deformed sections (caulked sections) are formed. The vane wheel 14 is fixed to the flange 12*b* by means of the deformed sections.

Figure 5:
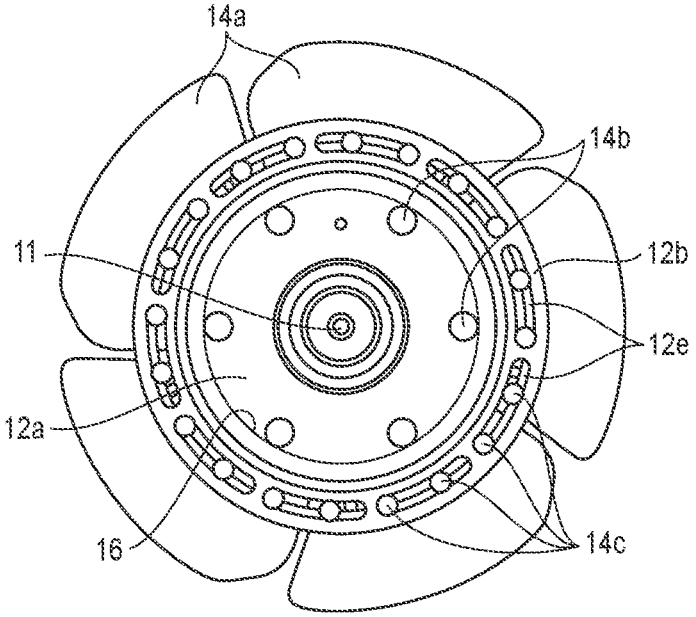
FIG. 5 is a bottom view of FIG. 1.

FIG. 5 shows the underside of the rotor 10. As shown in FIG. 5, in the vane wheel 14, the plurality of first protrusions 14*b* are engaged with the top section 12*a* of the holder 12, and plurality of second protrusions 14*c* are engaged with the flange 12*b* of the holder 12. Accordingly, even when the rotor 10 is rotated at a high rotational speed or is driven in a high-temperature environment, it is possible to prevent the vane wheel 14 made of a resin from being deformed in such a direction that the vane wheel 14 is separated from the holder 12.

Furthermore, the part of the vane wheel 14 corresponding to the side surface (outer circumference) of the holder 12 is fixed to the outer circumference of the holder 12 with, for example, an epoxide-based adhesive. However, the adhesive can be omitted.

The means for fixing the vane wheel 14 and holder 12 to each other is not limited to chemical adhesion based on an adhesive, and the holder 12 and vane wheel 14 may also be mechanically joined to each other by, for example, insert molding. Thereby, it is possible to further prevent the vane wheel 14 from being deformed.

It should be noted that as shown in FIG. 2 and FIG. 3, at the top section of the vane wheel 14 and around the circumference of the fixing member 13, a second groove 14*e* into which a weight (not shown) for adjusting the balance of the rotor 10 is inserted is provided.

Figure 6:
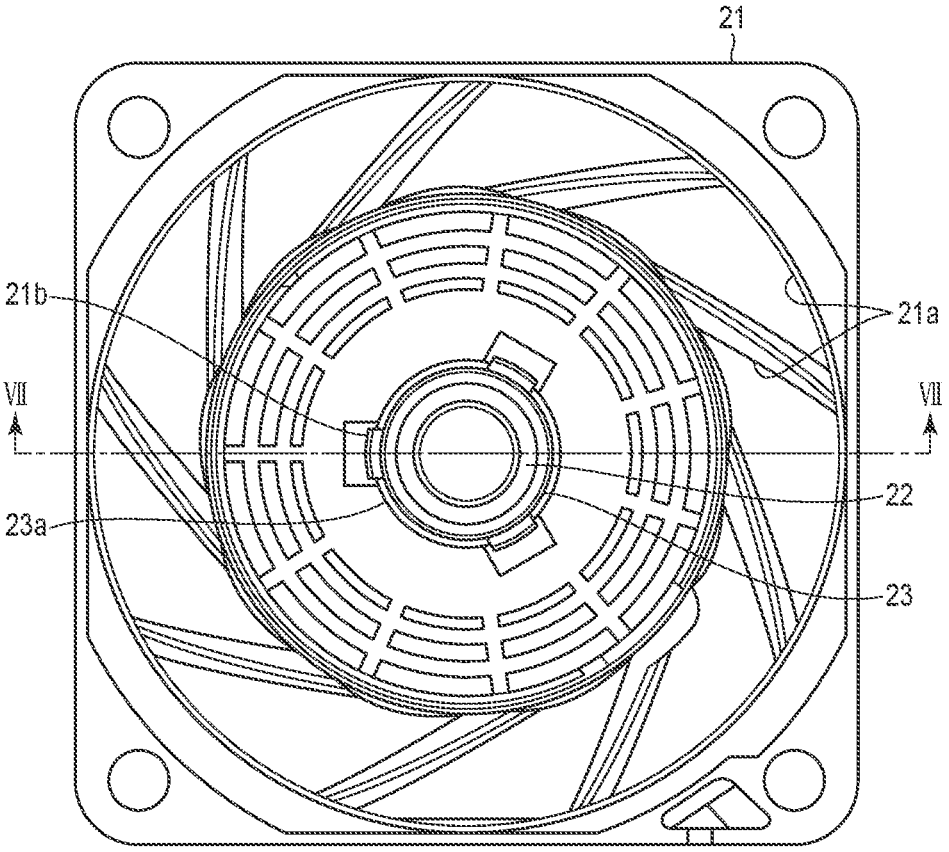
FIG. 6 is a plan view showing a housing associated with and taken out of the air blower according to the first embodiment.
Figure 7:
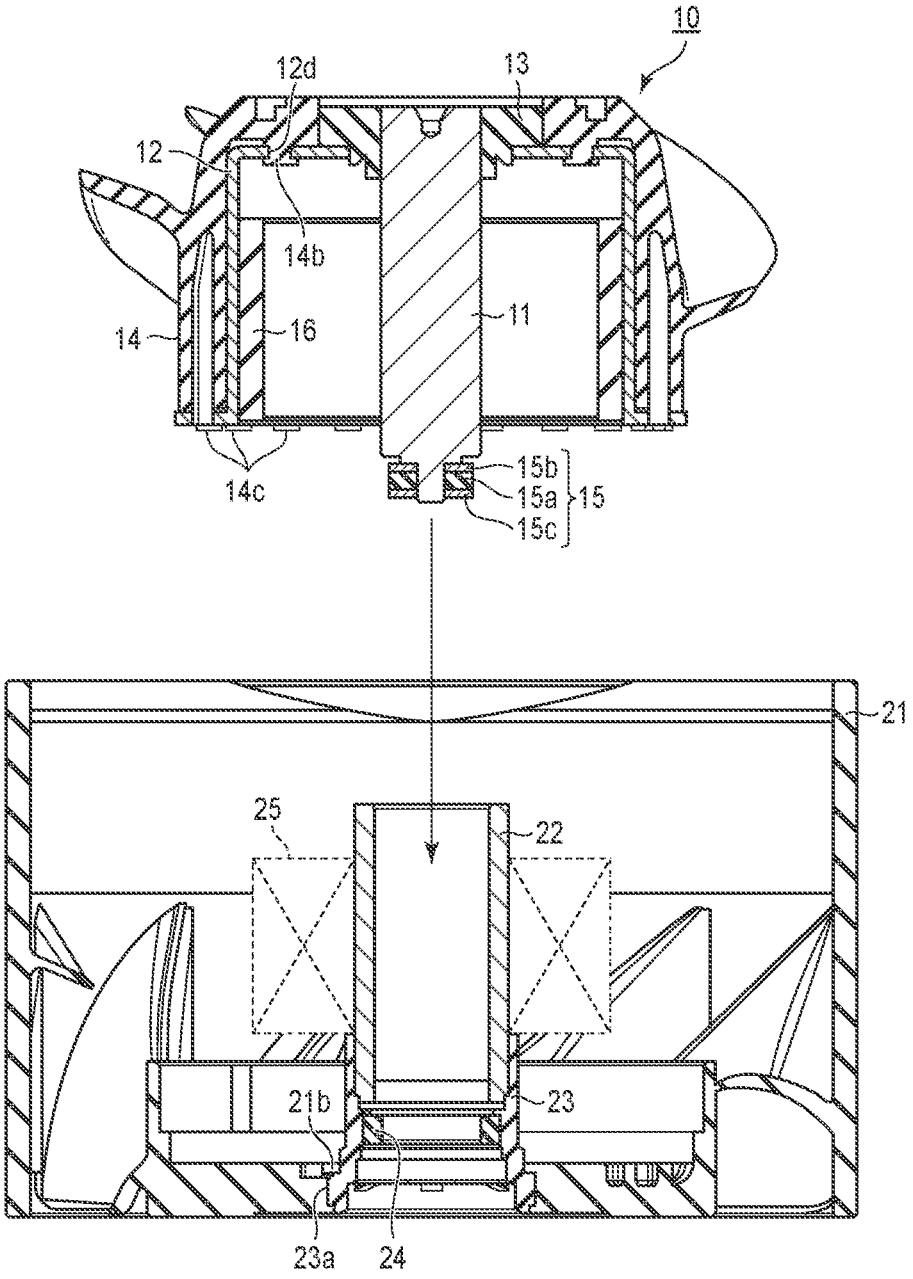
FIG. 7 is a view showing a cross section of the housing along line VII-VII of FIG. 6 and cross section of the rotor shown in FIG. 3.

FIG. 6 shows part of each of the housing and stator to be applied to the fan motor according to the first embodiment, and FIG. 7 schematically shows the relationship between the housing 21 and rotor 10.

At the bottom section of the housing 21, a plurality of opening sections 21*a* for intake or exhaust of air are provided.

At the bottom section of the housing 21 and at a central part thereof, a sleeve 22 serving as a bearing member is provided. The sleeve 22 has one end and the other end, and the shaft 11 of the rotor 10 is inserted into the inside of the sleeve 22 from the one end thereof.

The other end of the sleeve 22 is fixed to the inside of one end of a cylindrical supporting body 23. At the other end of the supporting body 23 and on the outer circumference thereof, a step section 23*a* is provided, and a plurality of engaging sections 21*b* provided on the bottom section of the housing 21 are engaged with this step section 23*a*. The engaging sections 21*b* are engaged with the step section 23*a* from a direction perpendicular to the radial direction of the sleeve 22.

More specifically, the housing 21 and the plurality of engaging sections 21*b* are formed integral with each other by using, for example, a resin material. Before the supporting body 23 is arranged, the engaging sections 21*b* are formed, for example, vertical and, after the supporting body 23 is arranged at the central part of the housing 21, the engaging sections 21*b* are deformed by thermal caulking utilizing, for example, ultrasonic waves, whereby the engaging sections 21*b* are engaged with the step section 23*a*. In this manner, the supporting body 23 is fixed to the housing 21.

As shown in FIG. 6, the housing 21 includes the three engaging sections 21*b*. However, the number of engaging sections 21*b* is not limited to three, and may be four or more. Alternatively, a ring-like engaging section may also be provided around the supporting body 23.

As shown in FIG. 7, inside the supporting body 23, a ring-like permanent magnet 24 constituting part of the magnetic bearing 15 is provided.

In the state where the shaft 11 is inserted into the inside of the sleeve 22, the aforementioned permanent magnet 15*a*, yoke 15*b*, and yoke 15*c* each constituting part of the magnetic bearing 15 are arranged apart from the permanent magnet 24 by a predetermined interval.

Further, around the sleeve 22, for example, a coil assembly 25 is provided, and the motor is constituted of the coil assembly 25 and permanent magnet 16.

In the above-mentioned configuration, by driving of the motor, the rotor 10 is rotated, the air introduced into the housing 21 from the one end or the other end thereof is sent to the other end or the one end of the housing 21 by the vane wheel 14.

According to the first embodiment described above, in the vane wheel 14 made of a resin provided on the metallic holder 12 of the rotor 10, the plurality of first protrusions 14*b* thereof are thermally caulked onto the plurality of first openings 12*d* provided in the top section 12*a* of the holder 12, and the plurality of second protrusions 14*c* thereof are thermally caulked onto the plurality of second openings 12*e* provided in the flange 12*b* of the holder 12. That is, the one end section and peripheral part of the other end section of the vane wheel 14 are fixed to the one end and peripheral part of the other end of the holder 12 at a plurality of positions. Accordingly, even when the rotor 10 is rotated at a high rotational speed or is driven in a high-temperature environment, it is possible to prevent the vane wheel 14 made of a resin from being deformed in such a direction that the vane wheel 14 is separated from the holder 12 due to a difference between the holder 12 and vane wheel 14 in strength or linear expansion coefficient of the material. Therefore, it is possible to avoid the problem that the balance of the rotor 10 is lost, and due to an increase in the load applied to the aero-dynamic pressure bearing or magnetic bearing, vibration or sound is caused or the life of the bearing or life of the product itself is shortened, and improve the performance of the fan motor.

In the first embodiment, the vane wheel 14 is fixed to the holder 12 by thermal caulking. Conversely, in a second embodiment, the vane wheel 14 is fixed to the holder 12 by using an anchor structure.

Figure 8:
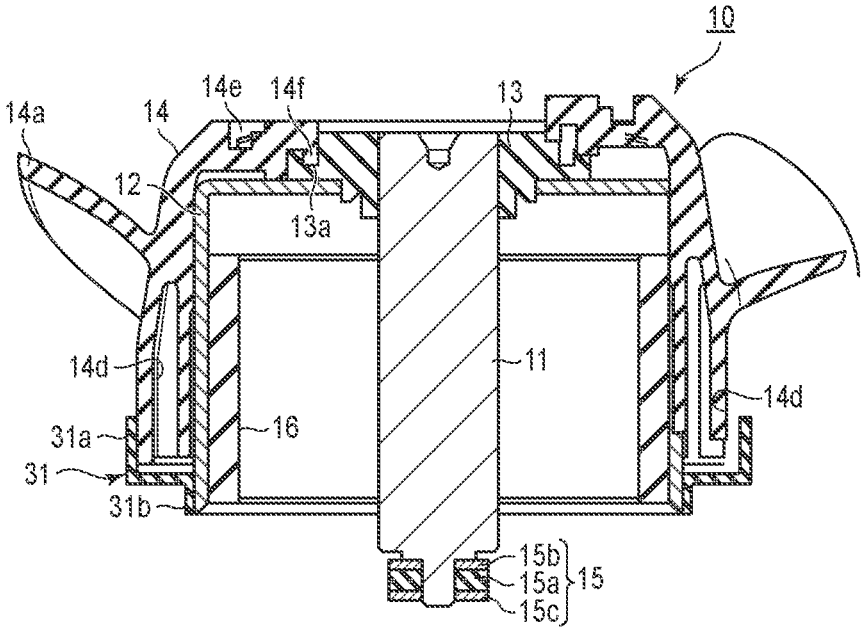
FIG. 8 is a cross-sectional view showing a rotor taken out of an air blower according to a second embodiment.

FIG. 8 shows the second embodiment. The fixing member 13 fixed to the shaft 11 includes, for example, a ring-like groove 13*a* serving as a first engaging section at a peripheral part thereof.

At one end section of the vane wheel 14 made of a resin, for example, a ring-like protrusion 14*f* serving as a second engaging section is provided, and this protrusion 14*f* is engaged with the ring-like groove 13*a*.

The groove 13*a* serving as the first engaging section and protrusion 14*f* serving as the second engaging section are not limited to the ring-like shape, and a plurality of grooves and protrusions may also be arranged according to the situation around the shaft 11.

Further, the first engaging section may also be made a protrusion, and second engaging section made also be made a groove. Furthermore, structures other than the groove and protrusion can also be used.

The holder 12 is made of, for example, a metal, and the center of the top section provided at one end thereof in the axial direction is fixed to the fixing member 13, and the holder 12 is rotated together with the shaft 11. At the other end of the holder 12 in the axial direction, a fixing ring 31 serving as a third engaging section is provided. The fixing ring 31 is provided on the outer circumference of the holder 12 and is engaged with the other end section of the vane wheel 14 in the axial direction and the outer circumference thereof.

More specifically, the fixing ring 31 has a cross section of a crank-like shape, one end 31*a* of the fixing ring 31 is separate from the side surface of the holder 12, and the other end 31*b* thereof is fixed to the side surface of the holder 12. The other end section of the vane wheel 14 in the axial direction is arranged between the one end 31*a* of the fixing ring 31 and side surface of the holder 12, and is fixed by the fixing ring 31.

Furthermore, the part of the vane wheel 14 corresponding to the side surface (outer circumference) of the holder 12 is fixed to the outer circumference of the holder 12 with, for example, an epoxide-based adhesive. However, the adhesive can be omitted.

The means for fixing the vane wheel 14 and holder 12 to each other is not limited to chemical adhesion based on an adhesive, and the holder 12 and vane wheel 14 may also be mechanically joined to each other by, for example, insert molding. Thereby, it is possible to further prevent the vane wheel 14 from being deformed.

According to the second embodiment described above, the fixing member 13 is provided with the groove 13*a* serving as the first engaging section, the one end section of the vane wheel 14 in the axial direction is provided with the protrusion 14*f* serving as the second engaging section to be engaged with the groove 13*a* and, furthermore, the other end of the holder 12 is provided with the fixing ring 31 serving as the third engaging section configured to fix the outer circumference of the other end section of the vane wheel 14. Accordingly, even when the rotor 10 is rotated at a high rotational speed or is driven in a high-temperature environment, it is possible to prevent the vane wheel 14 made of a resin from being deformed in such a direction that the vane wheel 14 is separated from the holder 12 due to a difference between the holder 12 and vane wheel 14 in strength or linear expansion coefficient of the material. Therefore, it is possible to avoid the problem that the balance of the rotor 10 is lost, and due to an increase in the load applied to the aero-dynamic pressure bearing or magnetic bearing, vibration or sound is caused or the life of the bearing or life of the product itself is shortened, and improve the performance of the fan motor.

Figure 9:
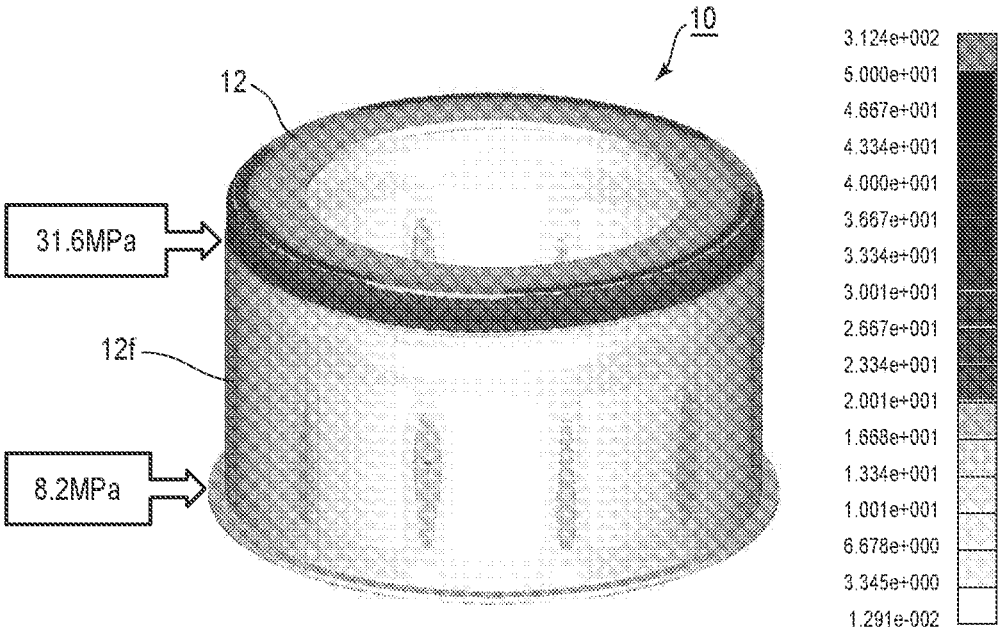
FIG. 9 is a view showing a simulation result of von Mises stress distribution at a joint section between a holder and vane wheel of the air blower according to the second embodiment.

FIG. 9 is a view showing a simulation result of von Mises stress distribution at a joint section 12*f* between the holder 12 and vane wheel 14 of the rotor 10 constituting the air blower according to the second embodiment, and the vane wheel 14 is omitted.

The conditions for the simulation are those of the following case where the diameter $\phi$ of the joint section 12*f*: 32.4 mm, rotational speed: 26300 r/min., environmental temperature: 85° C., material for the vane wheel 14: polyphenylene sulfide (PPS)(containing 40% glass fiber), and material for the holder 12: galvanized steel sheet.

Figure 10:
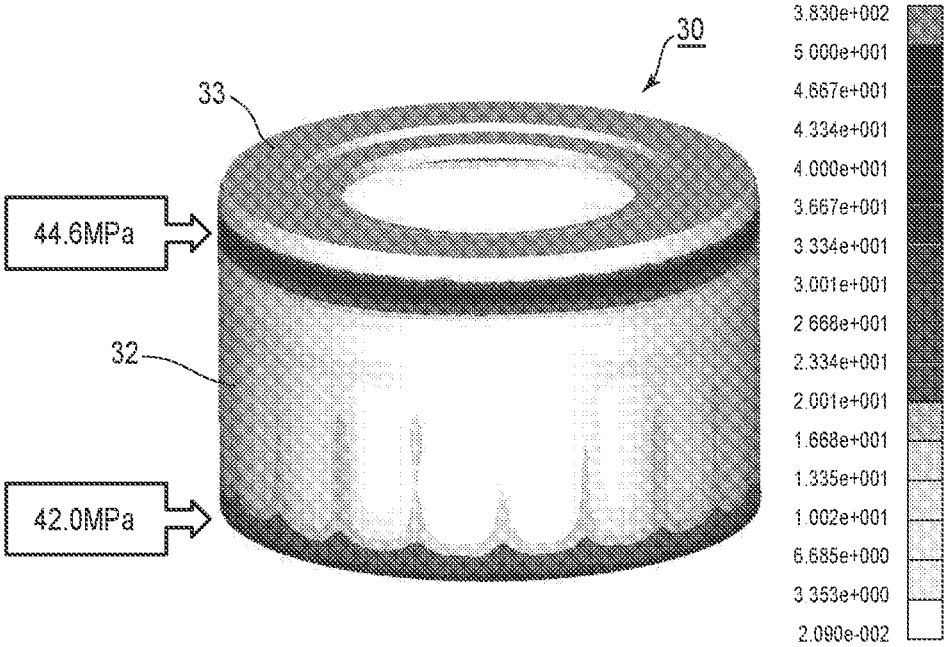
FIG. 10 is a view showing a simulation result of von Mises stress distribution at a joint section between a holder and vane wheel of the air blower taken as a comparative example.

FIG. 10 is a view showing a simulation result of von Mises stress distribution at a joint section 32 between a holder 33 and vane wheel of the rotor 30 constituting the air blower taken as a comparative example, and the vane wheel is omitted. The conditions for the simulation are identical to the second embodiment.

When the rotor 10 according to the second embodiment is rotated at a high rotational speed in the above-mentioned high-temperature environment, a stress of 8.2 MPa occurs at a lower part of the joint section 12*f* between the holder 12 and vane wheel 14, and stress of 31.6 MPa occurs at an upper part thereof.

On the other hand, in the case of the air blower taken as the comparative example shown in FIG. 10, a stress of 42.0 MPa greater than the second embodiment occurs at a lower part of the joint section 32, and a further greater stress of 44.6 MPa occurs at an upper part thereof.

As described above, according to the second embodiment, it is possible to largely reduce the stress occurring at the joint section 12*f* between the rotor 10 and vane wheel 14, and suppress the deformation of the vane wheel 14. Accordingly, it is possible to avoid the problem that due to an increase in the load applied to the aero-dynamic pressure bearing or magnetic bearing, vibration or sound is caused or the life of the bearing or life of the product itself is shortened, and improve the performance of the fan motor.

In the second embodiment described above, the vane wheel 14 is fixed to the holder 12 by using the anchor structure. Conversely, in a third embodiment, the vane wheel 14 is fixed to the holder 12 by using rings.

Figure 11:
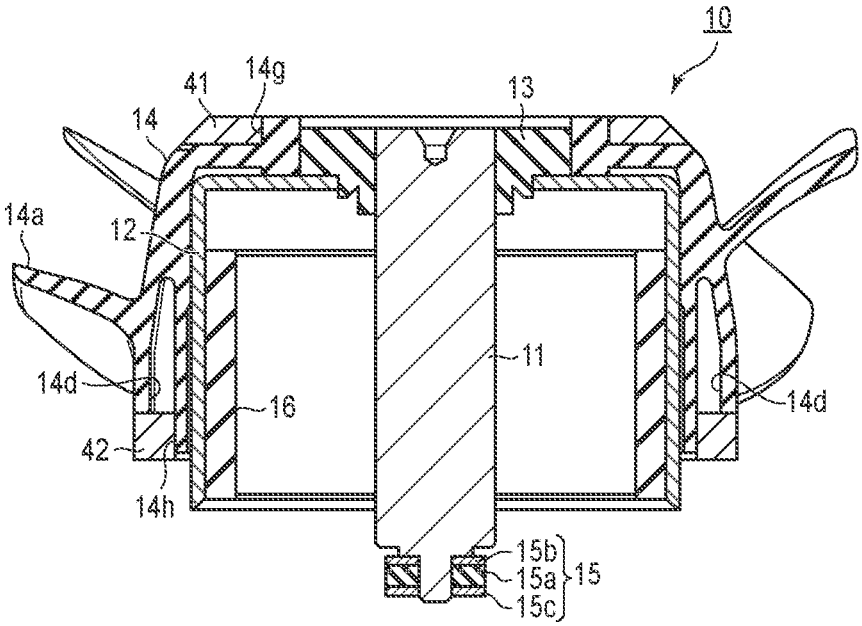
FIG. 11 is a cross-sectional view of a rotor taken out of an air blower according to a third embodiment.
Figure 12:
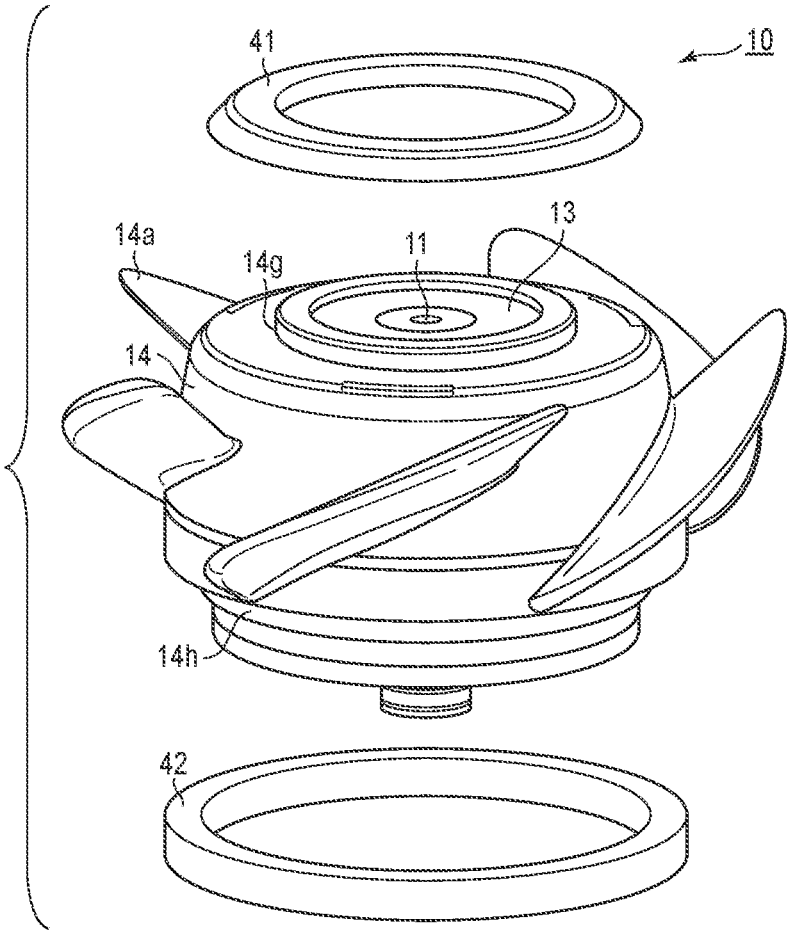
FIG. 12 is a perspective view showing the vane wheel part of the air blower according to the third embodiment in an exploded state.

FIG. 11 and FIG. 12 show the third embodiment. At one end section of the vane wheel 14 in the axial direction, and on a top section thereof, a ring-like step section 14*g* is provided along the outer circumference of the fixing member 13. A first ring 41 to be in contact with this step section 14*g* is provided on the top section of the vane wheel 14.

Further, at the other end section of the vane wheel 14 in the axial direction, and on the outer circumference thereof, a step section 14*h* is provided. A second ring 42 to be in contact with this step section 14*g* is provided at the other end section of the vane wheel 14. The second ring 42 blocks the first groove 14*d* of the vane wheel 14.

Furthermore, the part of the vane wheel 14 corresponding to the side surface (outer circumference) of the holder 12 is fixed to the outer circumference of the holder 12 with, for example, an epoxide-based adhesive. However, the adhesive can be omitted.

The means for fixing the vane wheel 14 and holder 12 to each other is not limited to chemical adhesion based on an adhesive, and the holder 12 and vane wheel 14 may also be mechanically joined to each other by, for example, insert molding. Thereby, it is possible to further prevent the vane wheel 14 from being deformed.

According to the third embodiment, the first ring 41 is provided at one end section of the vane wheel 14 in the axial direction, and second ring 42 is provided at the other end section thereof. Accordingly, even when the rotor 10 is rotated at a high rotational speed or is driven in a high-temperature environment, it is possible to prevent the vane wheel 14 made of a resin from being deformed in such a direction that the vane wheel 14 is separated from the holder 12 due to a difference between the holder 12 and vane wheel 14 in strength or linear expansion coefficient of the material. Therefore, it is possible to avoid the problem that the balance of the rotor 10 is lost, and due to an increase in the load applied to the aero-dynamic pressure bearing or magnetic bearing, vibration or sound is caused or the life of the bearing or life of the product itself is shortened, and improve the performance of the fan motor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An air blower comprising:

a rotatable shaft;

a cylindrical holder;

a fixing member provided on the shaft, and including a first engaging section provided along an outer circumference of the shaft;

a vane wheel provided on an outer circumference of the cylindrical holder and including a second engaging section to be engaged with the first engaging section at a first end section of the vane wheel in an axial direction; and a third engaging section provided at a first end section of the cylindrical holder in the axial direction and to be engaged with a second end section of the vane wheel in the axial direction, wherein the first engaging section is one of a ring-like groove and a ring-like protrusion.

2. The air blower of claim 1, wherein the cylindrical holder is made of a metal, and the vane wheel is made of a resin.

3. The air blower of claim 1, further comprising an adhesive configured to fix the vane wheel to the cylindrical holder.

4. The air blower of claim 1, wherein the vane wheel is a molded article fixed to the cylindrical holder by insert molding.

5. The air blower of claim 1, wherein the vane wheel includes a fourth engaging section being engaged with the first engaging section at a peripheral thereof.

6. The air blower of claim 5, wherein the fourth engaging section is one of a ring-like protrusion and a ring-like groove.

* * * * *